US011633952B2

(12) United States Patent
Nakano

(10) Patent No.: US 11,633,952 B2
(45) Date of Patent: Apr. 25, 2023

(54) LIQUID DISCHARGE HEAD AND LIQUID DISCHARGE APPARATUS

(71) Applicant: Kouichi Nakano, Ibaraki (JP)

(72) Inventor: Kouichi Nakano, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 99 days.

(21) Appl. No.: 17/467,467

(22) Filed: Sep. 7, 2021

(65) Prior Publication Data

US 2022/0080732 A1 Mar. 17, 2022

(30) Foreign Application Priority Data

Sep. 11, 2020 (JP) ..... JP2020-153130

(51) Int. Cl.
*B41J 2/14* (2006.01)
*B41J 2/045* (2006.01)

(52) U.S. Cl.
CPC ..... *B41J 2/14274* (2013.01); *B41J 2/04581* (2013.01); *B41J 2/14209* (2013.01); *B41J 2002/14217* (2013.01)

(58) Field of Classification Search
CPC ..... B41J 1/14274
See application file for complete search history.

(56) References Cited

U.S. PATENT DOCUMENTS 6,584,660 B1 * 7/2003 Shimogawa ..... H01L 41/0973 29/25.35
2005/0259135 A1 * 11/2005 Mita ..... B41J 2/14233 347/70
2006/0214998 A1 * 9/2006 Sugahara ..... B41J 2/14274 29/25.35
2008/0239018 A1 * 10/2008 Sekiguchi ..... B41J 2/14233 29/25.35
2010/0066789 A1 * 3/2010 Ogata ..... B41J 2/14274 347/70
2010/0140379 A1 * 6/2010 Suzuki ..... H01L 41/273 239/569

(Continued)

FOREIGN PATENT DOCUMENTS

JP 2003-226019 A 8/2003
JP 2007-062325 3/2007

(Continued)

OTHER PUBLICATIONS

Extended European Search Report dated Jan. 24, 2022 in European Patent Application No. 21193100.1, 8 pages.

*Primary Examiner* — Shelby L Fidler
(74) *Attorney, Agent, or Firm* — Xsensus LLP

(57) ABSTRACT

A liquid discharge head includes an individual liquid chamber having a nozzle through which a liquid is discharged in a liquid discharge direction, a piezoelectric element facing the individual liquid chamber, a first groove adjacent to the piezoelectric element in a nozzle array direction, a dummy individual liquid chamber without any nozzle, a dummy piezoelectric element facing the dummy individual liquid chamber, and a second groove adjacent to the dummy piezoelectric element in the nozzle array direction. The first groove extends in the liquid discharge direction. The second groove has a shorter length in the liquid discharge direction than the first groove.

9 Claims, 9 Drawing Sheets

(56) References Cited

U.S. PATENT DOCUMENTS

| | | | | |
|---|---|---|---|---|
| 2014/0194039 | A1* | 7/2014 | Horiguchi | B41J 2/1632 451/54 |
| 2015/0246536 | A1* | 9/2015 | Yoshida | B41J 2/1433 347/47 |
| 2019/0224974 | A1 | 7/2019 | Kihira et al. | |

FOREIGN PATENT DOCUMENTS

| | | |
|---|---|---|
| JP | 2008-132793 | 6/2008 |
| JP | 2020-011405 A | 1/2020 |

* cited by examiner

FIG. 1 COMPARATIVE EXAMPLE
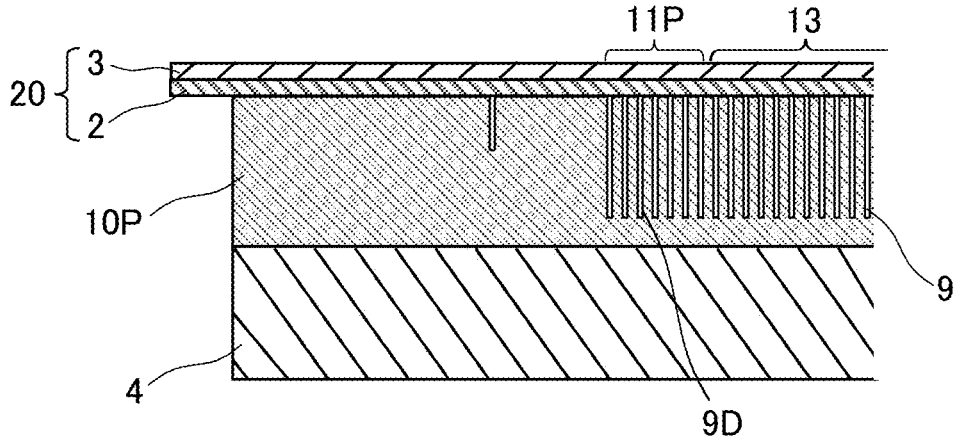
FIG. 2 COMPARATIVE EXAMPLE
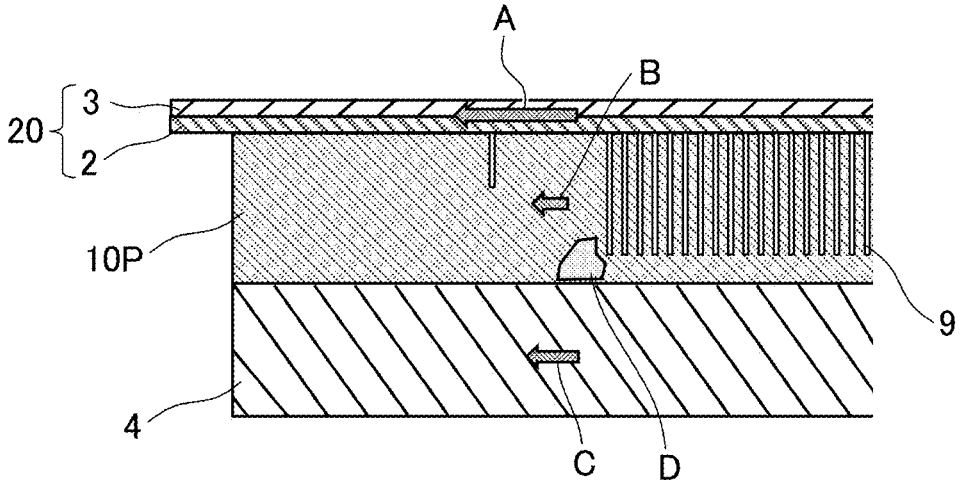

FIG. 3 COMPARATIVE EXAMPLE
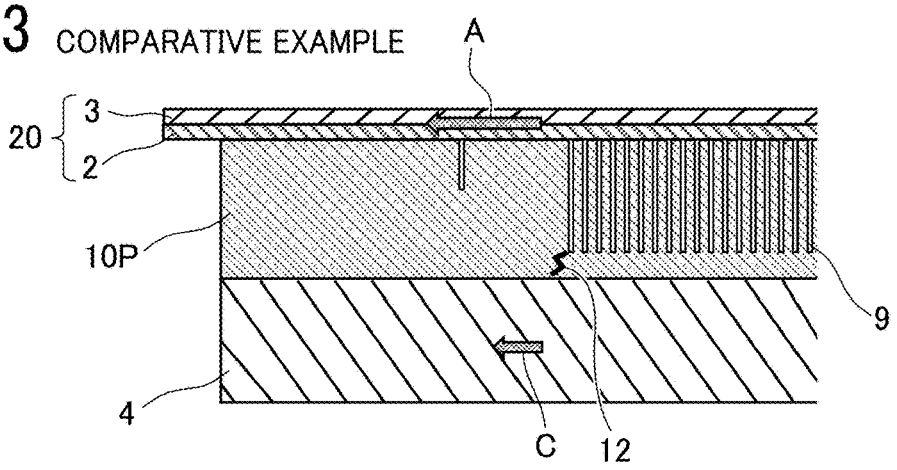
FIG. 4
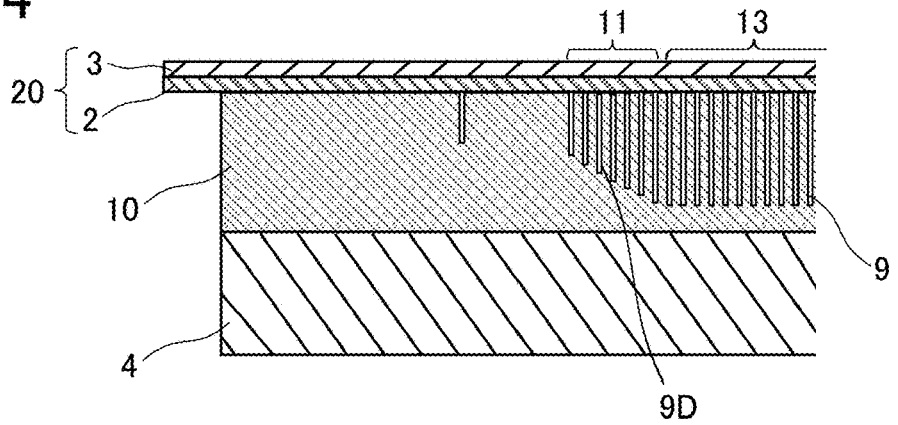
FIG. 5
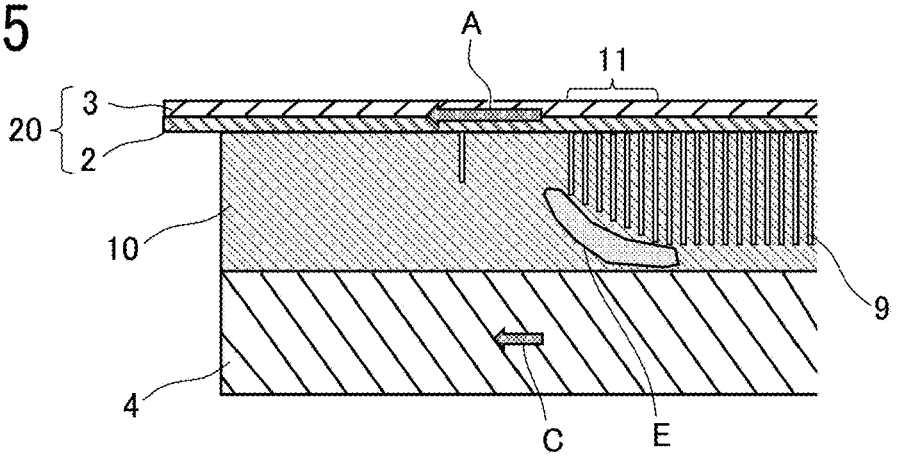

LIQUID DISCHARGE HEAD AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2020-153130, filed on Sep. 11, 2020, in the Japan Patent Office, the entire disclosure of which is hereby incorporated by reference herein.

BACKGROUND

Technical Field

Embodiments of the present disclosure relate to a liquid discharge head and a liquid discharge apparatus.

Description of the Related Art

A liquid discharge head, such as an inkjet head, discharges liquid from nozzles. The discharge speed and discharge volume of the liquid may vary at an outermost end portion of the liquid discharge head in a nozzle array direction. To suppress such a variation, a method is already known in which a dummy piezoelectric element to which a drive pulse is not applied is provided at the outermost end portion in the nozzle array direction of the liquid discharge head.

SUMMARY

Embodiments of the present disclosure describe an improved liquid discharge head that includes an individual liquid chamber having a nozzle through which a liquid is discharged in a liquid discharge direction, a piezoelectric element facing the individual liquid chamber, a first groove adjacent to the piezoelectric element in a nozzle array direction, a dummy individual liquid chamber without any nozzle, a dummy piezoelectric element facing the dummy individual liquid chamber, and a second groove adjacent to the dummy piezoelectric element in the nozzle array direction. The first groove extends in the liquid discharge direction. The second groove has a shorter length in the liquid discharge direction than the first groove.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 1 is a schematic view illustrating an example of a piezoelectric actuator included in a comparative liquid discharge head;

FIG. 2 is a schematic view illustrating the piezoelectric actuator heated by a heat source in the comparative liquid discharge head;

FIG. 3 is a schematic view illustrating a crack generated in the piezoelectric actuator heated by the heat source in the comparative liquid discharge head;

FIG. 4 is a schematic view illustrating an example of a piezoelectric actuator included in a liquid discharge head according to an embodiment of the present disclosure;

FIG. 5 is a schematic view of the piezoelectric actuator, in which stress is generated, included in the liquid discharge head according to an embodiment of the present disclosure;

Figure 6:
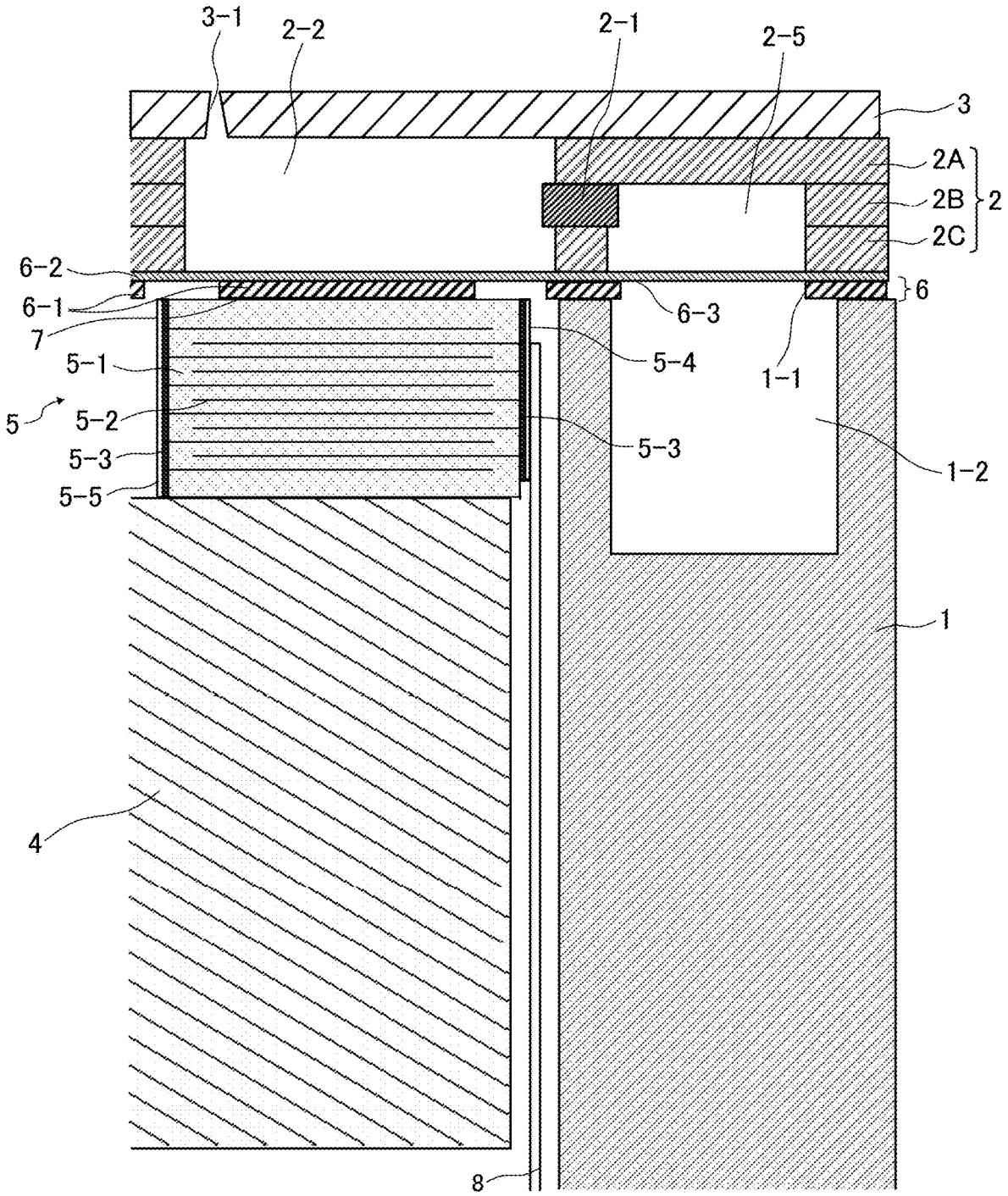
FIG. 6 is a cross-sectional view of the liquid discharge head according to an embodiment of the present disclosure, in a direction orthogonal to a nozzle array direction.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a," "an," and "the" are intended to include the plural forms as well, unless the context clearly indicates otherwise.

Embodiments of the present disclosure are described below with reference to the attached drawings. In the drawings for illustrating embodiments of the present disclosure, elements or components identical or similar in function or shape are given identical reference numerals as far as distinguishable, and redundant descriptions are omitted.

According to embodiments of the present disclosure, lengths of comb-shaped grooves of dummy piezoelectric elements (also referred to as "dummy piezoelectric vibrators") of a piezoelectric actuator changes stepwise to disperse stress concentrated in the piezoelectric actuator, thereby preventing the piezoelectric actuator from cracking.

A liquid discharge head according to embodiments of the present disclosure includes, for example, a nozzle (nozzle hole 3-1), an individual liquid chamber (individual liquid chamber 2-2), a piezoelectric element (piezoelectric element 5-6), a first groove (groove 9), a dummy individual liquid chamber (dummy individual liquid chamber 2-2D), a dummy piezoelectric element (dummy piezoelectric element 5-6D), and a second groove (groove 9D). The liquid discharge head discharges liquid through the nozzle in a liquid discharge direction. The individual liquid chamber has the nozzle. The piezoelectric element faces the individual liquid chamber. The first groove is disposed adjacent to the piezoelectric element. The dummy individual liquid chamber does not have the nozzle. The dummy piezoelectric element faces the dummy individual liquid chamber. The second groove is disposed adjacent to the dummy piezoelectric element. The first groove extends in the liquid discharge direction. The second groove has a shorter length in the liquid discharge direction than the first groove. The components with reference numerals in the parentheses "( )" correspond to the configuration illustrated in FIGS. 6 to 10 described later as an example.

The above described embodiment of the present disclosure is described below in detail with reference to the following drawings. First, drawbacks of a comparative liquid discharge head are described with reference to FIGS. 1 to 3, and an outline of features of the liquid discharge head according to embodiments of the present disclosure is described with reference to FIGS. 4 to 5.

FIG. 1 is a schematic view illustrating an example of a piezoelectric actuator included in a comparative liquid discharge head. FIG. 1 illustrates a cross-section of the piezoelectric actuator in a nozzle array direction. FIGS. 2 to 5 described later also illustrate cross-sections of the piezoelectric actuator in the nozzle array direction.

As illustrated in FIG. 1, a piezoelectric actuator 10P is secured to a base 4 and bonded between the base 4 and a nozzle plate 20. The nozzle plate 20 also serves as components that define a liquid chamber. The nozzle plate 20 includes, for example, a channel substrate 2 provided with the components that define the liquid chamber and a nozzle substrate 3 provided with nozzle holes (also referred to as "nozzles"). A plurality of nozzles is arrayed on the nozzle substrate 3 (i.e., the nozzle array direction).

The piezoelectric actuator 10P includes a plurality of comb-shaped grooves 9 in a piezoelectric element region 13. A dummy piezoelectric element region 11P is disposed adjacent to an outermost end of the comb-shaped grooves 9. A plurality of comb-shaped grooves 9D are formed in the dummy piezoelectric element region 11P.

A heater or the like is mounted on the liquid discharge head to keep the ink viscosity constant. The heater is mounted around the nozzle plate 20, the piezoelectric actuator 10P, and the base 4 to heat the nozzle plate 20, the piezoelectric actuator 10P, and the base 4.

In general, the piezoelectric actuator 10P, the base 4, the components that define the liquid chamber, and the nozzle plate 20 are made of different materials. Since linear expansion coefficients of the respective materials are different from each other, strain occurs in the liquid discharge head due to heat of a heat source, such as heat generated when the piezoelectric elements (vibrators) are driven or heat generated by the internal heater of the liquid discharge head.

FIG. 2 is a schematic view illustrating the piezoelectric actuator 10P heated by the heat source. When the heater generates heat, as illustrated in FIG. 2, expansion A of the nozzle plate 20, expansion B of the piezoelectric actuator 10P, and expansion C of the base 4 occur. Normally, the nozzle plate 20 and the base 4 are made of metals such as stainless steel, and have a larger linear expansion coefficient than the piezoelectric actuator 10P made of ceramics. If the nozzle plate 20 and the base 4 are made of stainless steel, but different types of stainless steel, the linear expansion coefficients may be different between the nozzle plate 20 and the base 4. Further, the nozzle plate 20, the piezoelectric actuator 10P, and the base 4 are not uniformly heated to the same temperature by the heater depending on the distances from the heater or the difference in the heat conductivities of the respective materials. In particular, when the heater starts heating, the temperature difference becomes more pronounced.

As a result, the expansion A of the nozzle plate 20, the expansion B of the piezoelectric actuator 10P, and the expansion C of the base 4 are different from each other. At this time, stress is concentrated in the piezoelectric actuator 10P sandwiched between the nozzle plate 20 and the base 4, thereby generating stress D (shear stresses) in the piezoelectric actuator 10P.

FIG. 3 is a schematic view illustrating an example of a crack generated in the piezoelectric actuator 10P heated by the heater (heat source). When the stress D in the piezoelectric actuator 10P exceeds the tensile strength of the piezoelectric actuator 10P, a crack 12 is generated in the piezoelectric actuator 10P as illustrated in FIG. 3. As described above, in the comparative liquid discharge head, since the grooves 9D in the dummy piezoelectric element region 11P of the piezoelectric actuator 10P have the same length as the grooves 9 in the piezoelectric element region 13, thermal stress is concentrated on the comb-shaped groove 9D at the outermost end in the dummy piezoelectric element region 11P.

Therefore, a method of dispersing the stress concentrated in the piezoelectric actuator is applied to the liquid discharge head according to the present embodiment so as to prevent the piezoelectric actuator from cracking (e.g., the crack 12 illustrated in FIG. 3).

FIG. 4 is a schematic view illustrating an example of a piezoelectric actuator 10 included in the liquid discharge head according to the present embodiment. In the present embodiment, as illustrated in FIG. 4, the piezoelectric actuator 10 includes a dummy piezoelectric element region 11, in which the lengths of the comb-shaped grooves 9D change stepwise, adjacent to the end of the comb-shaped groove 9 in the piezoelectric element region 13.

FIG. 5 is a schematic view of the piezoelectric actuator 10, in which stress is generated, included in the liquid discharge head according to the present embodiment. The lengths of the comb-shaped grooves 9D in the dummy piezoelectric element region 11 changes stepwise so as to disperse stress such as stress E of the piezoelectric actuator 10 illustrated in FIG. 5, thereby preventing the piezoelectric actuator 10 from cracking.

Figure 7:
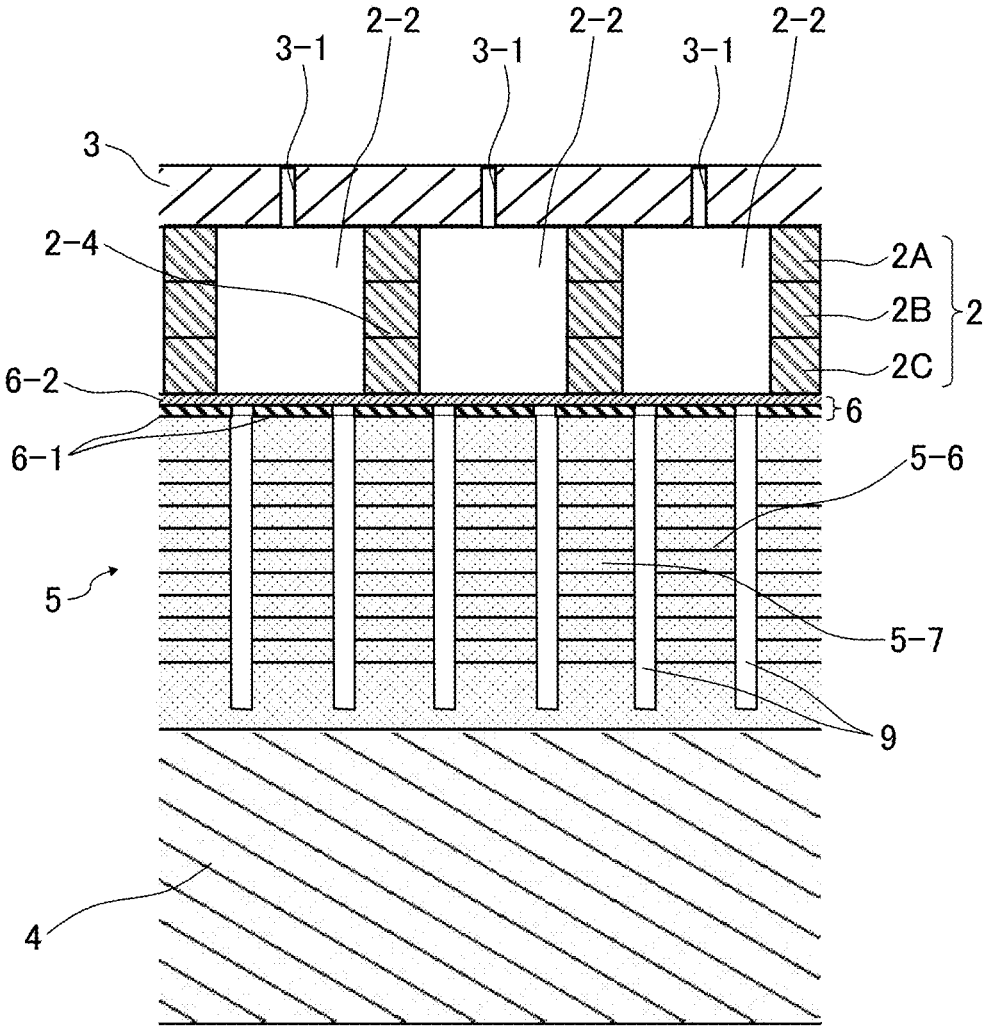
FIG. 7 is a cross-sectional view in the nozzle array direction, illustrating a configuration of an individual liquid chamber having a nozzle hole and the surrounding components of the liquid discharge head.
Figure 8:
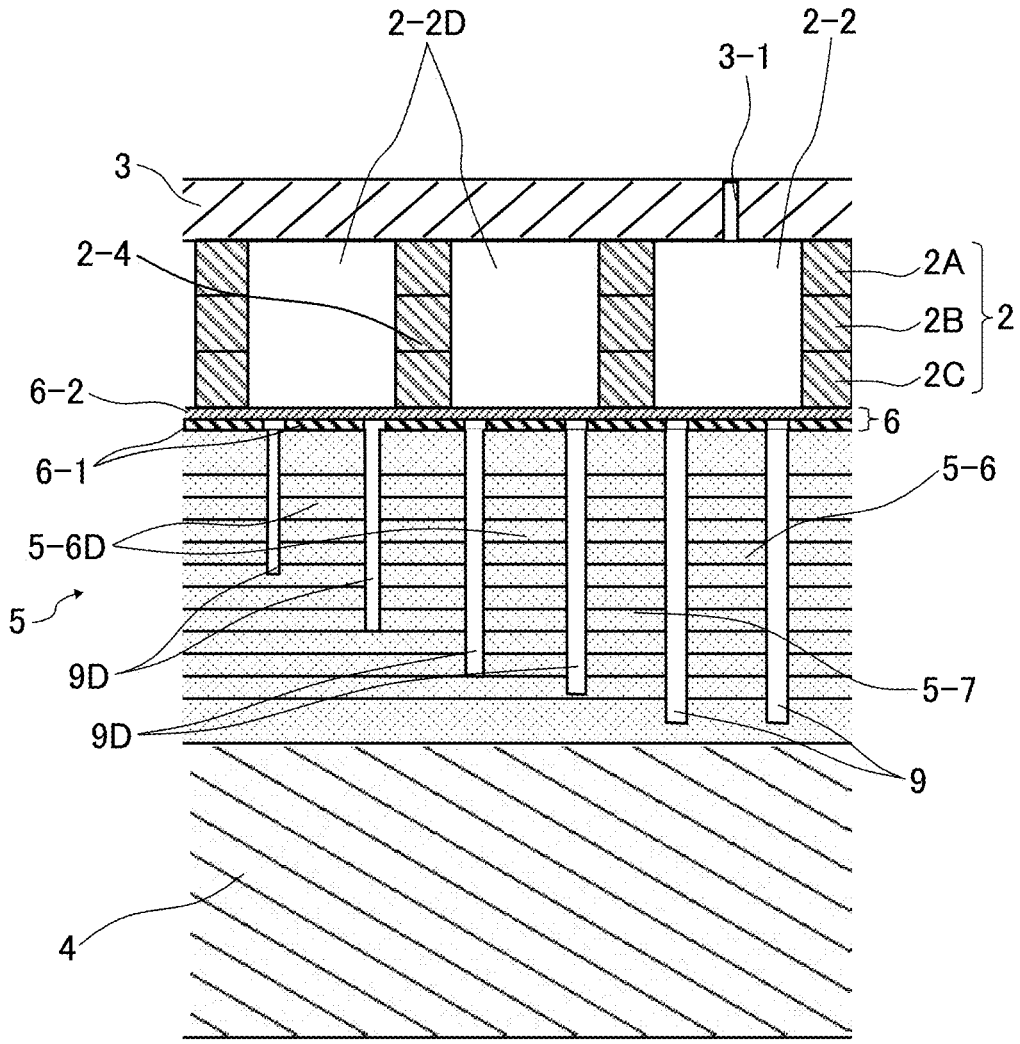
FIG. 8 is a cross-sectional view in the nozzle array direction, illustrating a configuration of an individual liquid chamber without the nozzle hole and the surrounding components of the liquid discharge head.
Figure 9:
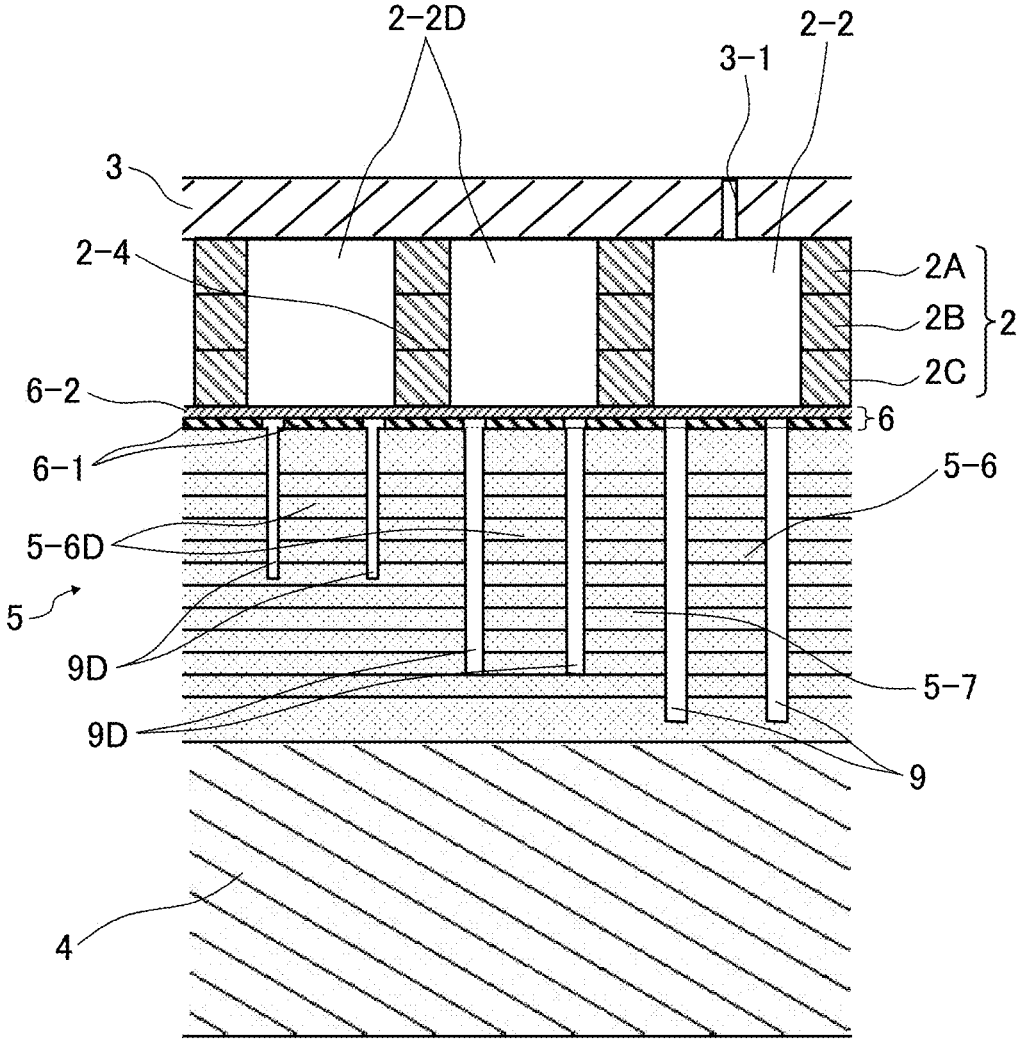
FIG. 9 is a cross-sectional view in the nozzle array direction, illustrating another configuration of the individual liquid chamber without the nozzle hole and the surrounding components of the liquid discharge head.

The liquid discharge head according to embodiments of the present disclosure is described below. FIG. 6 is a cross-sectional view of the liquid discharge head according to the present embodiment in a direction (pressure-chamber longitudinal direction) orthogonal to the nozzle array direction of the liquid discharge head. FIG. 7 is a cross-sectional view in the nozzle array direction, illustrating a configuration of an individual liquid chamber 2-2 having a nozzle hole 3-1 and the surrounding components of the liquid discharge head. FIG. 8 is a cross-sectional view in the nozzle array direction, illustrating a configuration of a dummy individual liquid chamber 2-2D without the nozzle hole 3-1 and the surrounding components of the liquid discharge head. FIG. 9 is a cross-sectional view in the nozzle array direction, illustrating another configuration of the dummy individual liquid chamber 2-2D without the nozzle hole 3-1 and the surrounding components of the liquid discharge head.

The liquid discharge head includes a frame 1, the channel substrate 2, the nozzle substrate 3, a diaphragm substrate 6, a laminated piezoelectric element 5, and the base 4. An ink supply port 1-1 and a common liquid chamber 1-2 are carved in the frame 1. A fluid restrictor 2-1, the individual liquid chamber 2-2 (also referred to as a "pressure generation chamber"), and an introduction channel 2-5 are carved in the channel substrate 2. A nozzle hole 3-1 is formed in the nozzle substrate 3. The diaphragm substrate 6 includes a projection 6-1, a diaphragm 6-2, and an ink inlet 6-3. The laminated piezoelectric element 5 is bonded to the diaphragm substrate 6 via an adhesive layer 7 and secured to the base 4. The laminated piezoelectric element 5 and the diaphragm substrate 6 construct the piezoelectric actuator 10 to pressurize liquid in the individual liquid chamber 2-2 as described with reference to FIGS. 4 and 5.

The base 4 is made of steel special use stainless (SUS), and the laminated piezoelectric elements 5 are joined to the base 4 in two rows. The laminated piezoelectric element 5 includes, for example, piezoelectric layers 5-1 made of lead zirconate titanate (PZT) having a thickness of 10 μm to 50 μm per layer and internal electrode layers 5-2 made of silver-palladium (AgPd) having a thickness of several μm per layer. The piezoelectric layers 5-1 and the internal electrode layers 5-2 are alternately laminated in the laminated piezoelectric element 5. Each of the internal electrode layers 5-2 is connected to a corresponding one of external electrodes 5-3 disposed on both sides of the laminated piezoelectric element 5.

The laminated piezoelectric element 5 is divided in a comb shape by half-cut dicing. The divided laminated piezoelectric elements 5 alternately serves as a piezoelectric element 5-6 (drive portion) and a support 5-7 (non-drive portion) as illustrated in FIG. 7. The external electrode 5-3 on one side is divided by half-cut dicing and the length of the external electrode 5-3 is regulated by processing of being cut off, for example, thereby serving as a plurality of individual electrodes 5-4. The external electrode 5-3 on the other side is not divided by half-cut dicing and serves as a common electrode 5-5.

A flexible printed circuit (FPC) 8 is soldered to the individual electrodes 5-4 of the piezoelectric element 5-6. The common electrode 5-5 is connected to a ground electrode of the FPC 8 via an electrode layer disposed at an end portion of the laminated piezoelectric element 5. A driver integrated circuit (IC) are mounted on the FPC 8 to control a drive voltage applied to the piezoelectric element 5-6.

The diaphragm substrate 6 is made of two layers of Ni alloy plating films overlapped by electroforming. The diaphragm substrate 6 includes the thin film diaphragm 6-2, the projection 6-1 having an island shape, and an opening as the ink inlet 6-3. The projections 6-1 are formed on the diaphragm 6-2 and include island portions joined to the piezoelectric elements 5-6 of the laminated piezoelectric element 5 and thick-film portions including a beam joined to the supports 5-7 or the frame 1.

The projections 6-1 of the diaphragm substrate 6 are bonded to the piezoelectric element 5-6 or the support 5-7 of the laminated piezoelectric element 5, or the frame 1 with the adhesive layer 7 patterned on the diaphragm substrate 6. The adhesive layer 7 includes gap materials.

The channel substrate 2 includes channel substrates 2A, 2B, and 2C. Through holes serves as the fluid restrictor 2-1, the individual liquid chamber 2-2, and the introduction channel 2-5 are etched on the channel substrates 2A, 2B, and 2C made of SUS. In the channel substrates 2A, 2B, and 2C, residual portions that are not etched at the same positions constructs partitions 2-4 between the individual liquid chambers 2-2.

FIG. 7 is a cross-sectional view of the individual liquid chamber 2-2 having the nozzle hole 3-1 and the surrounding thereof. FIG. 8 is a cross-sectional view of a dummy individual liquid chamber 2-2D without the nozzle hole 3-1 and the surrounding thereof. FIG. 7 illustrates a portion in which three individual liquid chambers 2-2 are arranged, and FIG. 8 illustrates a portion in which one individual liquid chamber 2-2 and two dummy individual liquid chambers 2-2D are arranged.

In the liquid discharge head, a plurality of individual liquid chambers 2-2 and a plurality of dummy individual liquid chambers 2-2D are arranged in the nozzle array direction. The arrangement direction of the plurality of individual liquid chambers 2-2 and the arrangement direction of the plurality of dummy individual liquid chambers 2-2D are the same as the nozzle array direction. The nozzle array direction is a direction intersecting the liquid discharge direction (for example, a direction orthogonal to the liquid discharge direction). The plurality of dummy individual liquid chambers 2-2D are arranged adjacent to an end of the plurality of individual liquid chambers 2-2 in the arrangement direction (on the side closer to an end of the liquid discharge head than the plurality of individual liquid chambers 2-2).

The grooves 9 and the grooves 9D define the piezoelectric element 5-6 facing the individual liquid chamber 2-2 and the dummy piezoelectric element 5-6D facing the dummy individual liquid chamber 2-2D, respectively. The grooves 9 are disposed at two positions adjacent to one side of the piezoelectric element 5-6 and the other side of the piezoelectric element 5-6 (i.e., on both sides of the piezoelectric element 5-6) in the piezoelectric element region 13. The groove 9 extending in the liquid discharge direction, which defines the piezoelectric element 5-6, is also referred to as a first groove.

The grooves 9D are disposed at two positions adjacent to one side of the dummy piezoelectric element 5-6D and adjacent to the other side of the dummy piezoelectric element 5-6D (i.e., on both sides of the dummy piezoelectric element 5-6D) in the dummy piezoelectric element region 11. The groove 9D shorter than the groove 9 in the liquid discharge direction, which defines the dummy piezoelectric element 5-6D, is also referred to as a second groove.

FIGS. 8 and 9 illustrates a boundary portion between the individual liquid chamber 2-2 and the dummy individual liquid chamber 2-2D. The left side in FIGS. 8 and 9 corresponds to the end of the liquid discharge head. The plurality of individual liquid chambers 2-2 having nozzle holes 3-1 are arranged on the right side. For example, in FIGS. 8 and 9, two grooves 9 on the right side define the piezoelectric element 5-6, two grooves 9D on the left side define the dummy piezoelectric element 5-6D on the left side, and two grooves 9D at the center (third and fourth grooves from the left) define the dummy piezoelectric element 5-6D at the center.

As illustrated in FIG. 7, the groove 9 adjacent to each of the piezoelectric elements 5-6 has substantially the same length. On the other hand, as illustrated in FIGS. 8 and 9, the groove 9D adjacent to each of the dummy piezoelectric elements 5-6D is shorter in the liquid discharge direction at a position farther from the individual liquid chamber 2-2 (piezoelectric element 5-6). Thus, stress is not concentrated on the dummy piezoelectric element 5-6D disposed at the outermost end portion of the liquid discharge head, thereby preventing the piezoelectric actuator 10 from cracking.

Specifically, as illustrated in FIG. 8, the grooves 9D may be shorter from the groove 9D defining the dummy piezoelectric element 5-6D disposed next to the piezoelectric element 5-6 facing the individual liquid chamber 2-2 toward the groove 9D close to the end of the liquid discharge head in order. In FIG. 8, in the two grooves 9D defining one dummy piezoelectric element 5-6D, the groove 9D far from the individual liquid chamber 2-2 (piezoelectric element 5-6) is shorter in the liquid discharge direction than the groove 9D close thereto. That is, the two grooves 9D have different lengths.

Alternatively, as illustrated in FIG. 9, the two grooves 9D defining one dummy piezoelectric element 5-6D may have substantially the same length, and a combination of the two grooves 9D may be shorter toward the groove 9D close to the end of the liquid discharge head. In FIG. 9, the grooves 9D are shorter stepwise for each combination of two grooves 9D.

In both examples illustrated in FIGS. 8 and 9, the lengths in the liquid discharge direction of the two grooves 9D disposed on both sides of the dummy piezoelectric element 5-6D are shorter at a position farther from the individual liquid chamber 2-2 (piezoelectric element 5-6), respectively or for each combination of two grooves 9D.

The liquid discharge head according to the present embodiment includes the groove 9D adjacent to the dummy piezoelectric element 5-6D shorter in the liquid discharge direction than the groove 9 adjacent to the piezoelectric element 5-6, but is not limited to the above-described examples.

In another example, a heating device such as a temperature control channel or a heater may be attached to the liquid discharge head. In such a case, the heat transfer efficiency may change depending on the shape of the dummy piezoelectric element 5-6D. Therefore, the configuration as illustrated in FIG. 8 or 9 can be appropriately selected, thereby achieving both the heat transfer efficiency and crack prevention. The plurality of grooves 9D are not limited to the configuration in which the lengths in the liquid discharge direction of the grooves 9D are shorter stepwise toward the end of the liquid discharge head.

For example, the lengths in the liquid discharge direction of the grooves 9D are shorter than the grooves 9, and some of the grooves 9D may be shorter on the side close to the individual liquid chamber 2-2 than on the side far from the individual liquid chamber 2-2. In the plurality of grooves 9D, the groove 9D closest to the end of the liquid discharge head is preferably shorter in the liquid discharge direction than the groove 9D closest to the individual liquid chamber 2-2. However, for example, the lengths in the liquid discharge direction of the grooves 9D may increase and decrease between the end of the liquid discharge head and the individual liquid chamber 2-2.

Figure 10:
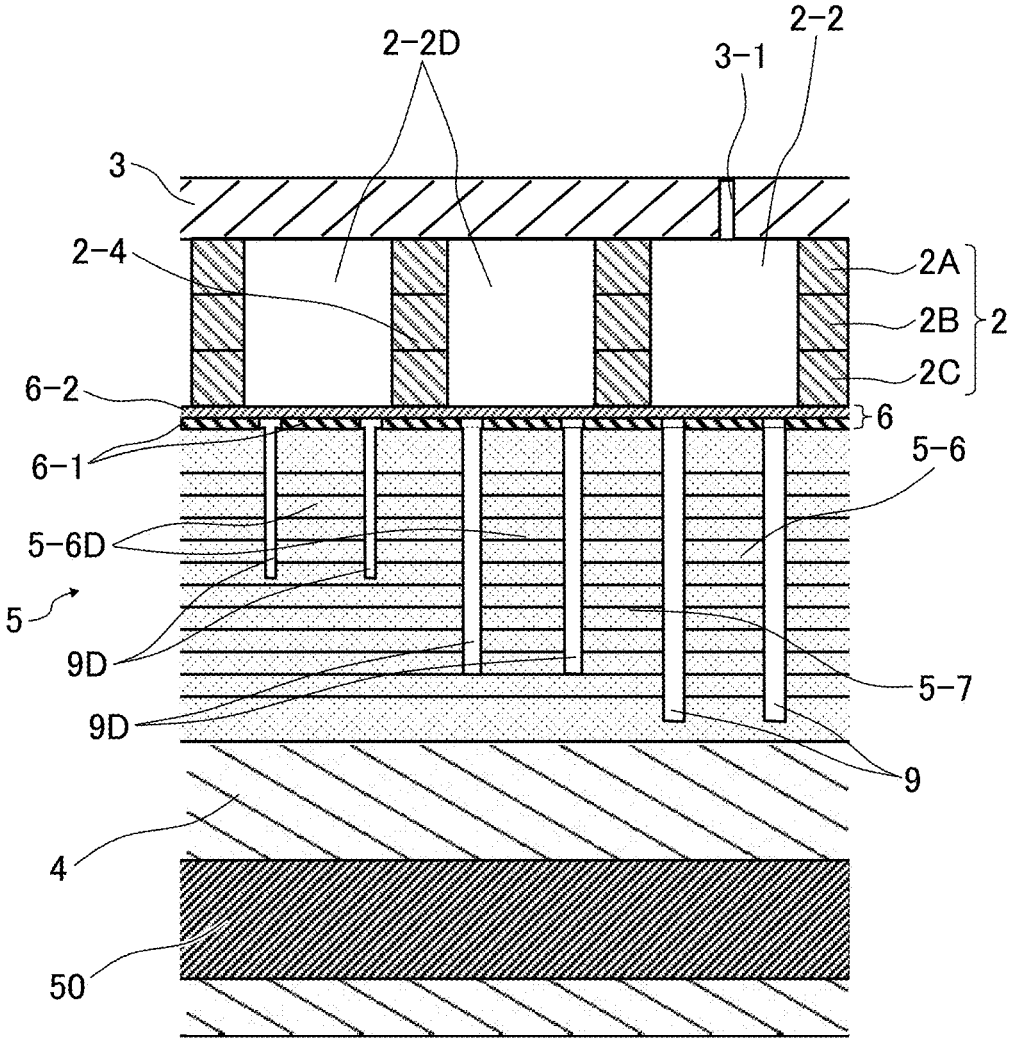
FIG. 10 is a cross-sectional view in the nozzle array direction, illustrating a configuration of the liquid discharge head including a heating device.

FIG. 10 is a cross-sectional view illustrating a configuration of the liquid discharge head including a heating device 50 such as a temperature control channel. As an example of the heating device 50, the temperature control channel through which a heated liquid flows can adjust the temperature of the liquid discharge head (individual liquid chamber 2-2). Instead of the temperature control channel, an electric heater or both the temperature control channel and the electric heater may be directly attached. As illustrated in FIG. 10, the heating device 50, the dummy piezoelectric element 5-6D, the diaphragm substrate 6, the dummy individual liquid chamber 2-2D, and the nozzle substrate 3 are arranged in this order in the liquid discharge direction. Here, the heating device 50 and the dummy piezoelectric element 5-6D are preferably stacked in the liquid discharge direction. In the present embodiment, the heating device 50 is embedded in the base 4, but the position of the heating device 50 is not limited thereto. Such a configuration facilitates adjusting the heat transfer efficiency described above.

As described above, in the liquid discharge head according to the above embodiments, the lengths of the comb-shaped grooves of the dummy piezoelectric element of the piezoelectric actuator changes stepwise. Therefore, stress concentrated on the root of the dummy piezoelectric element at the outermost end can be dispersed, thereby preventing the piezoelectric actuator from cracking.

Next, a liquid discharge head including the above-described piezoelectric actuator, a liquid discharge unit including the liquid discharge head, and a liquid discharge apparatus are described.

The term "liquid discharge head" used herein is a functional component to discharge liquid through nozzles.

Liquid to be discharged through the nozzles of the liquid discharge head is not limited to a particular liquid as long as the liquid has a viscosity or surface tension to be discharged from the liquid discharge head. However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink; surface treatment liquid; a liquid for forming an electronic element component, a light-emitting element component, or an electronic circuit resist pattern; or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a thermal resistor, and an electrostatic actuator including a diaphragm and a counter electrode.

The liquid discharge head is not limited in the type of pressure generator used. For example, the above-described piezoelectric actuator (which may use a laminated piezoelectric element), a thermal actuator using a thermoelectric conversion element such as a thermal resistor, and an electrostatic actuator including a diaphragm and a counter electrode.

The "liquid discharge unit" refers to a liquid discharge head integrated with functional components or mechanisms, i.e., an assembly of components related to liquid discharge. For example, the "liquid discharge unit" includes a combination of the liquid discharge head with at least one of a head tank, a carriage, a supply mechanism, a maintenance mechanism, and a main-scanning moving mechanism.

Herein, the terms "integrated" and "combined" mean attaching the liquid discharge head and the functional components (or mechanisms) to each other by fastening, screwing, binding, or engaging and movably holding one of the liquid discharge head and the functional components relative to the other. The liquid discharge head, the functional components, and the mechanisms may also be detachably attached to one another.

For example, the liquid discharge head and the head tank are integrated as the liquid discharge unit. Alternatively, the liquid discharge head and the head tank coupled (connected)

to each other via a tube or the like may form the liquid discharge unit as a single unit. Here, a unit including a filter may further be added to a portion between the head tank and the liquid discharge head.

In another example, the liquid discharge unit may include the liquid discharge head integrated with the carriage as a single unit.

As yet another example, the liquid discharge unit is a unit in which the liquid discharge head and the main-scanning moving mechanism are combined into a single unit. The liquid discharge head is movably held by a guide that is a part of the main-scanning moving mechanism. The liquid discharge unit may include the liquid discharge head, the carriage, and the main-scanning moving mechanism that are integrated as a single unit.

In still another example, a cap that is a part of the maintenance mechanism may be secured to the carriage mounting the liquid discharge head so that the liquid discharge head, the carriage, and the maintenance mechanism are combined into a single unit to form the liquid discharge unit.

Further, in still another example, the liquid discharge unit includes tubes connected to the head tank or the liquid discharge head mounting the channel component so that the liquid discharge head and the supply mechanism are integrated as a single unit. Through the tubes, the liquid in a liquid storage source is supplied to the liquid discharge head.

The main-scanning moving mechanism may be a guide only. The supply mechanism may be a tube(s) only or a loading device only.

In the above-described embodiments, the "liquid discharge apparatus" includes the liquid discharge head or the liquid discharge unit and drives the liquid discharge head to discharge liquid. The liquid discharge apparatus may be, for example, an apparatus capable of discharging liquid to a material to which the liquid can adhere and an apparatus to discharge liquid toward gas or into liquid.

The "liquid discharge apparatus" may include devices relating to feeding, conveyance, and ejection of the material to which the liquid can adhere and also include a pretreatment device and a post-processing device.

The "liquid discharge apparatus" may be, for example, an image forming apparatus to form an image on a sheet by discharging ink, or a three-dimensional apparatus to discharge a fabrication liquid to a powder layer in which powder material is formed in layers, so as to form a three-dimensional object.

The "liquid discharge apparatus" is not limited to an apparatus that discharges liquid to visualize meaningful images such as letters or figures. For example, the liquid discharge apparatus may be an apparatus that forms meaningless images such as meaningless patterns or an apparatus that fabricates three-dimensional images.

The above-described term "material to which liquid can adhere" denotes, for example, a material to which liquid can adhere at least temporarily, a material to which liquid can attach and firmly adhere, or a material to which liquid can adhere and into which the liquid permeates. Specific examples of the "material to which liquid can adhere" include, but are not limited to, a recording medium such as a paper sheet, recording paper, a recording sheet of paper, a film, or cloth, an electronic component such as an electronic substrate or a piezoelectric element, and a medium such as layered powder, an organ model, or a testing cell. The "material to which liquid is adhere" includes any material to which liquid can adhere, unless particularly limited.

Examples of the "material to which liquid can adhere" include any materials to which liquid can adhere even temporarily, such as paper, thread, fiber, fabric, leather, metal, plastic, glass, wood, and ceramic.

The term "liquid discharge apparatus" may be an apparatus to relatively move the liquid discharge head and the material to which liquid can adhere. However, the liquid discharge apparatus is not limited to such an apparatus. Examples of the liquid discharge apparatus include a serial type apparatus which moves the liquid discharge head, and a line type apparatus which does not move the liquid discharge head.

Examples of the liquid discharge apparatus further include: a treatment liquid applying apparatus that discharges a treatment liquid onto a paper sheet to apply the treatment liquid to the surface of the paper sheet, for reforming the surface of the paper sheet; and an injection granulation apparatus that injects a composition liquid, in which a raw material is dispersed in a solution, through a nozzle to granulate fine particle of the raw material.

The terms "image formation," "recording," "printing," "image printing," and "fabricating" used in the present embodiments may be used synonymously with each other.

Figure 11:
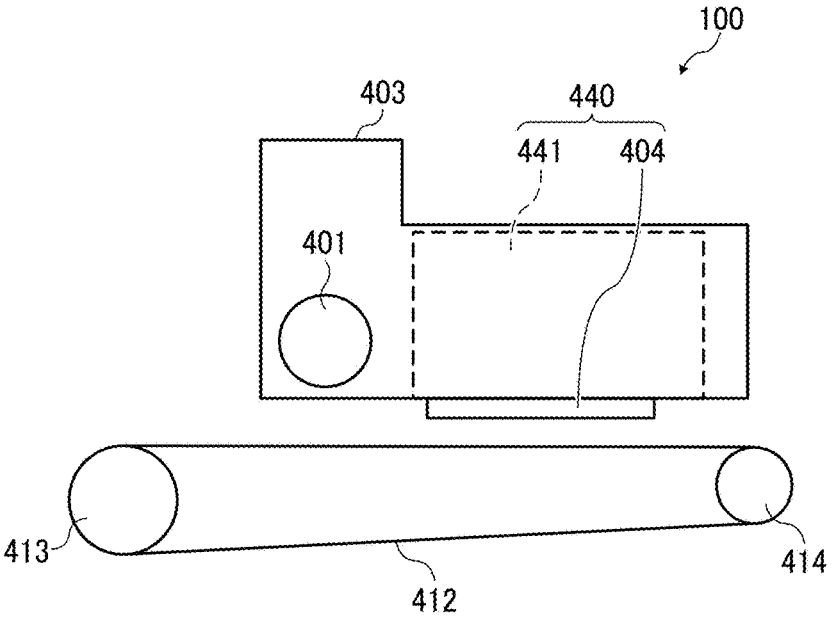
FIG. 11 is a side view of a part of a liquid discharge apparatus according to an embodiment of the present disclosure.

An example of a liquid discharge apparatus according to embodiments of the present disclosure is described with reference to FIG. 11. FIG. 11 is a side view of a part of a liquid discharge apparatus 100 according to the present embodiment, and illustrates a configuration of a liquid discharge unit 440 including a liquid discharge head 404 and a head tank 441. The liquid discharge apparatus 100 includes the liquid discharge unit 440, a guide 401, a carriage 403, a conveyance belt 412, a conveyance roller 413, and a tension roller 414. The liquid discharge head 404 according to embodiments of the present disclosure and the head tank 441 are combined into the liquid discharge unit 440 as a single unit.

The liquid discharge unit 440 is mounted on the carriage 403. The liquid discharge head 404 of the liquid discharge unit 440 discharges color liquids of, for example, yellow (Y), cyan (C), magenta (M), and black (K). The liquid discharge head 404 is mounted on the carriage 403 such that a nozzle array including a plurality of nozzles is arranged in a sub-scanning direction perpendicular to the main scanning direction. The liquid discharge head 404 discharges the color liquid downward to the material conveyed on the conveyance belt 412.

Figure 12:
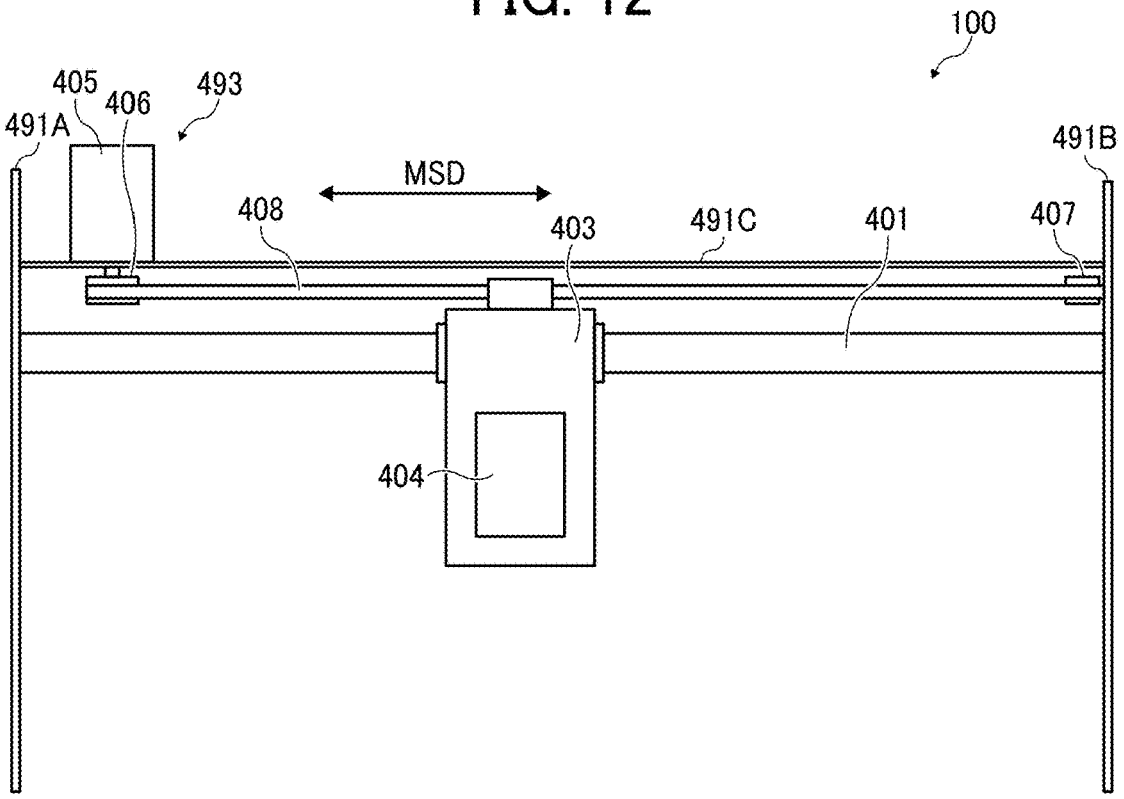
FIG. 12 is a plan view of a part of a liquid discharge apparatus according to another embodiment of the present disclosure.

Another example of a liquid discharge apparatus according to embodiments of the present disclosure is described with reference to FIG. 12. FIG. 12 is a plan view of a part of the liquid discharge apparatus 100 and illustrates a configuration of a liquid discharge unit including a liquid discharge head 404, a carriage 403, and a main-scanning moving mechanism 493.

The liquid discharge apparatus includes a liquid discharge unit, a guide 401, a main scanning motor 405, a drive pulley 406, a driven pulley 407, a timing belt 408, and a housing including side plates 491A and 491B, and a back plate 491C. The liquid discharge unit includes the main-scanning moving mechanism 493, the carriage 403, and the liquid discharge head 404. The main-scanning moving mechanism moves the carriage 403 including the liquid discharge head 404 in the main scanning direction indicated by arrow MSD in FIG. 12.

Figure 13:
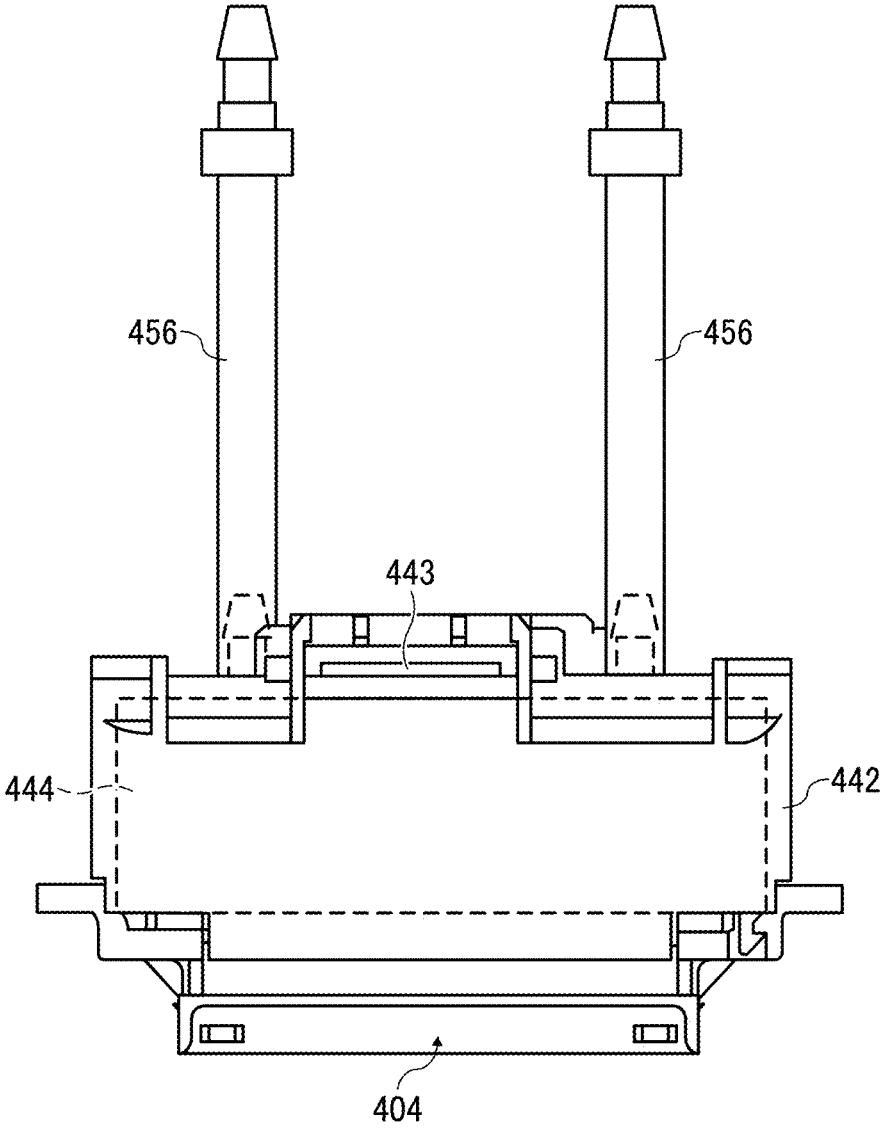
FIG. 13 is a front view illustrating an example of a liquid discharge unit of the liquid discharge apparatus.

Next, still another example of a liquid discharge unit included in the liquid discharge apparatus according to embodiments of the present disclosure is described with reference to FIG. 13. FIG. 13 is a front view illustrating the liquid discharge unit and illustrates a configuration of the liquid discharge unit including a liquid discharge head 404 and a supply mechanism.

The liquid discharge unit includes the liquid discharge head 404 to which a channel component 444 is attached and tubes 456 connected to a channel component 444. The channel component 444 is disposed inside a cover 442. The liquid discharge unit may include the head tank 441 instead of the channel component 444. A connector 443 for electrically connecting to the liquid discharge head 404 is provided on an upper portion of the channel component 444.

According to the above-described embodiments of the present disclosure, the stress concentrated on the dummy piezoelectric element can be dispersed, thereby preventing the piezoelectric actuator from cracking.

Although the preferred embodiments of the present disclosure have been described above, the present disclosure is not limited to the embodiments described above, and a variety of modifications can naturally be made within the scope of the present disclosure. For example, elements and/or features of different illustrative embodiments may be combined with each other and/or substituted for each other within the scope of the present disclosure.

What is claimed is:

1. A liquid discharge head comprising:

an individual liquid chamber having a nozzle through which a liquid is discharged in a liquid discharge direction;

a piezoelectric element facing the individual liquid chamber;

a first groove adjacent to the piezoelectric element in a nozzle array direction, the first groove extending in the liquid discharge direction;

a dummy individual liquid chamber without any nozzle;

a dummy piezoelectric element facing the dummy individual liquid chamber; and a second groove adjacent to the dummy piezoelectric element in the nozzle array direction, the second groove having a shorter length in the liquid discharge direction than the first groove.

2. The liquid discharge head according to claim 1, wherein the dummy individual liquid chamber, the dummy piezoelectric element, and the second groove include a plurality of dummy individual liquid chambers, a plurality of dummy piezoelectric elements, and a plurality of second grooves, respectively, wherein the plurality of dummy individual liquid chambers is disposed adjacent to the individual liquid chamber on a side close to an end of the liquid discharge head in the nozzle array direction, and wherein lengths of the second grooves in the liquid discharge direction are shorter at a position farther from the individual liquid chamber.

3. The liquid discharge head according to claim 1, wherein each of the second grooves is a pair of second grooves between which each of the dummy piezoelectric elements is disposed, and wherein the second grooves in the pair have the same length.

4. The liquid discharge head according to claim 1, wherein each of the second grooves is a pair of second grooves between which each of the dummy piezoelectric elements is disposed, and wherein the second grooves in the pair have different lengths.

5. The liquid discharge head according to claim 1, wherein the dummy individual liquid chamber, the dummy piezoelectric element, and the second groove include a plurality of dummy individual liquid chambers, a plurality of dummy piezoelectric elements, and a plurality of second grooves, respectively, wherein the plurality of dummy individual liquid chambers is disposed adjacent to the individual liquid chamber on a side close to an end of the liquid discharge head in the nozzle array direction, and wherein one of the second grooves closest to the end of the liquid discharge head has a shorter length in the liquid discharge direction than another one of the second grooves closest to the individual liquid chamber.

6. The liquid discharge head according to claim 1, further comprising a heating device configured to adjust a temperature of the individual liquid chamber.

7. The liquid discharge head according to claim 6, further comprising:

a nozzle substrate in which the nozzle is formed; and a diaphragm substrate configured to pressurize the liquid in the individual liquid chamber together with the piezoelectric element, wherein the heating device, the dummy piezoelectric element, the diaphragm substrate, the dummy individual liquid chamber, and the nozzle substrate are arranged in this order in the liquid discharge direction.

8. The liquid discharge head according to claim 7, wherein the heating device and the dummy piezoelectric element are stacked in the liquid discharge direction.

9. A liquid discharge apparatus comprising:

the liquid discharge head according to claim 1.

* * * * *